US005882018A

United States Patent [19]

Petrosino

[11] Patent Number: 5,882,018

[45] Date of Patent: Mar. 16, 1999

[54] MULTI-STATE SUPPORT

[76] Inventor: Chris Petrosino, 245 East Dr., Copiague, N.Y. 11726

[21] Appl. No.: 96,027

[22] Filed: Jun. 11, 1998

Related U.S. Application Data

[63] Continuation-in-part of Ser. No. 594,308, Jan. 30, 1996, abandoned.

[51] Int. Cl.[6] ..... A63C 17/20

[52] U.S. Cl. ..... 280/7.13; 36/100; 36/115; 280/11.22; 280/11.27; 280/43.24

[58] Field of Search ..... 280/7.12, 7.13, 280/9, 11.19, 11.22, 11.26, 11.27, 825, 43.23, 43.24; 36/100, 115

[56] References Cited

U.S. PATENT DOCUMENTS

| | | | |
|---|---|---|---|
| 2,919,926 | 1/1960 | Schwarz . | |
| 2,944,636 | 7/1960 | Rockwell . | |
| 3,096,991 | 7/1963 | Crankshaw | 280/43.24 |
| 3,224,785 | 12/1965 | Stevenson . | |
| 3,263,765 | 8/1966 | Just et al. | 280/43.24 X |
| 3,995,723 | 12/1976 | Holcomb, Jr. . | |
| 4,108,455 | 8/1978 | James | 280/43.24 X |
| 5,280,930 | 1/1994 | Smathers . | |
| 5,320,367 | 6/1994 | Landis . | |
| 5,340,131 | 8/1994 | Smathers . | |
| 5,398,970 | 3/1995 | Tucky . | |
| 5,551,715 | 9/1996 | Pickard | 280/43.24 |
| 5,609,346 | 3/1997 | Belluhumeur . | |
| 5,785,327 | 7/1998 | Gallant | 280/11.27 |

*Primary Examiner*—J. J. Swann
*Assistant Examiner*—Michael Mar
*Attorney, Agent, or Firm*—McAulay Nissen; Goldberg Kiel & Hand, LLP

[57] ABSTRACT

The multi-state support provides the use of pressurized fluid to cause expansion of an expandable volume positioned above a roller assembly which, in turn, places the support in either a rolling or non-rolling state. In a first embodiment, the roller assembly is fixed relative to a support surface. Expansion of the volume results in contact between a wall of the expandable volume and the rollers of the roller assembly. This contact prevents rotation of the rollers and defines the non-rolling state. In a second embodiment, the roller assembly is moveable relative to the support surface. Expansion of the volume results in the contact between a wall of the expandable volume and the roller support without interfering with the ability of the rollers to rotate relative to the roller support. Expansion of the volume causes the extension of the rollers of the roller assembly from within the sole. The extension of the rollers from the sole defines the rolling state.

4 Claims, 8 Drawing Sheets

MULTI-STATE SUPPORT

This application is a continuation of Ser. No. 08/594,308 filed on Jan. 30, 1996 now abandoned.

BACKGROUND OF THE INVENTION

1. Field of the Invention

This invention relates to a multi-state support and more particularly, to a support which provides rolling and non-rolling states.

2. Description of the Related Art

Roller skating has always been an exciting recreational sport. In order to provide rollers on which one may skate, it is necessary to either remove one's shoes and replace them with roller skates or attach to one's shoes, removable skating assemblies. In either case, however, one must remove the skate in order to walk without significant difficulty. Examples of skates and skating assemblies which are known in the art are disclosed in U.S. Pat. No. 1,271,891, No. 1,616,442, No. 2,548,391, No. 3,306,623, No. 4,988,122, and 5,362,076. Each of the references listed above teaches a roller skate that must be removed to permit walking without significant difficulty.

U.S. Pat. No. 4,355,474 teaches a flexible sheet to be placed over the wheels of a traditional roller skate so as to provide a walking surface and thus, eliminate the need to remove the skates to permit walking. The sheet, however, must be removed from the skate and must be carried by the user. Since this sheet is removable, it is susceptible to loss.

U.S. Pat. No. 3,979,842, No. 3,983,643, No. 4,333,249, and No. 5,398,970 each illustrate mechanically positioned retractable rollers which may be stored in the shoe sole to provide a shoe or which may be extended from the sole to provide a skate. In each of the references teaching mechanically extending rollers, the user must take his weight off the shoe to extend the roller. As a result, the user must stop and sit to transform from one mode of transportation to the other. Furthermore, the skating rollers are rigidly connected to the shoe and do not provide for shock absorption. Also, in each of the references providing for roller storage, the height of the skate is increased, thus increasing the risk of serious ankle injury to the user while skating.

U.S. Pat. No. 4,873,774 and No. 5,299,369 each illustrate retractable cleats which employ fluid pressure to effect retracted and extended states.

U.S. Pat. No. 5,353,525 and No. 5,362,076 illustrate inflatable bladders for providing support to the user's foot and/or ankle within a shoe or skate.

It is an object of the present invention to provide a support which converts easily between rolling and non-rolling states.

It is another object of the present invention to provide a support which employs pressurized fluid to effect a change in the state occupied by the support.

It is a further objective of the present invention to minimize the risk of injury to a skater using the support as a skating/walking shoe.

It is also an object of the present invention to provide shock absorption when the support is used as a skating/walking shoe.

It is a further object of the present invention to provide a support which converts between rolling and non-rolling states, the individual components thereof being attached to the support while the support occupies either the rolling or the non-rolling states.

BRIEF DESCRIPTION

The present invention provides the use of pressurized fluid to cause expansion of an expandable volume positioned above the roller assembly which, in turn, places the support in either the rolling or non-rolling states.

In a first embodiment, the roller assembly is fixed relative to a support surface. Expansion of the volume results in contact between a wall of the expandable volume and the rollers of the roller assembly. This contact prevents rotation of the rollers and defines the non-rolling state.

In a second embodiment, the roller assembly is moveable relative to the support surface. Expansion of the volume results in the contact between a wall of the expandable volume and the roller support without interfering with the ability of the rollers to rotate relative to the roller support. Expansion of the volume causes the extension of the rollers of the roller assembly from within the support. The extension of the rollers from the support defines the rolling state.

DETAILED DESCRIPTION OF THE PREFERRED EMBODIMENTS

Figure 1:
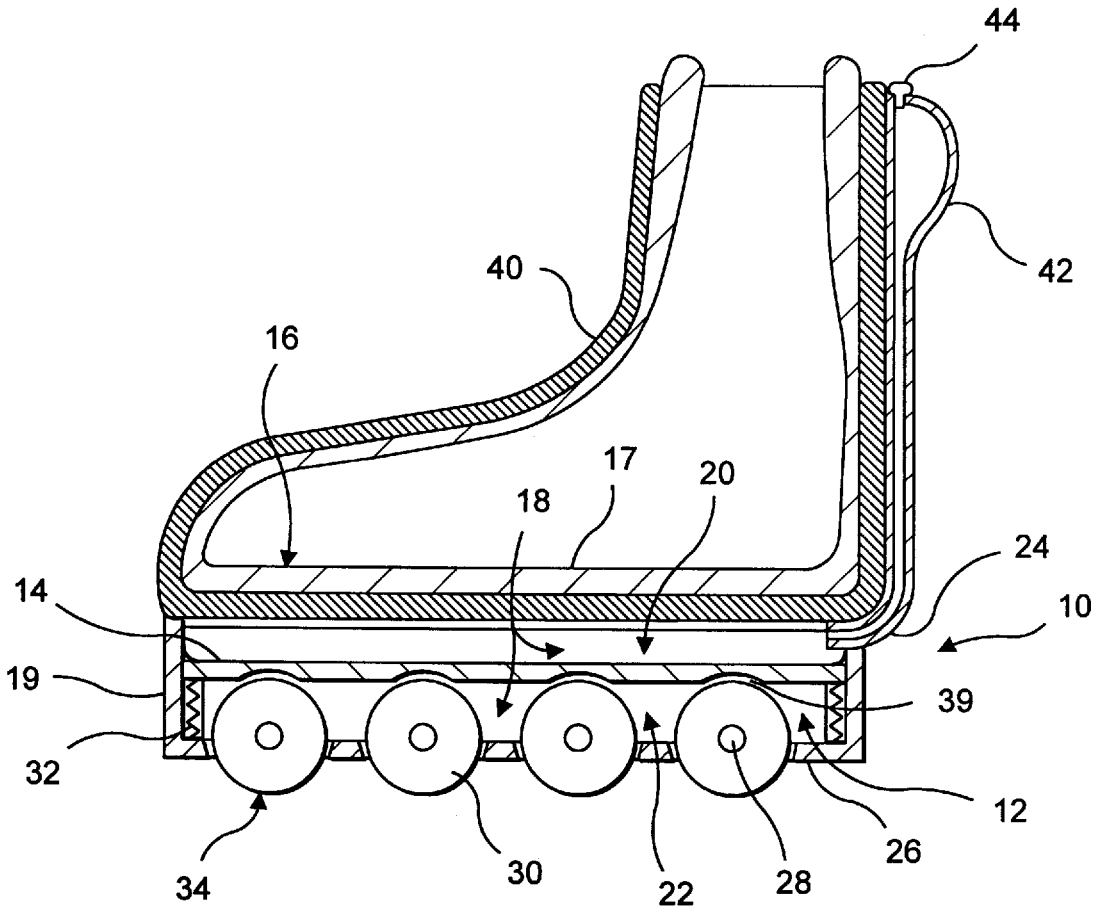
FIG. 1 is a longitudinal, cross-sectional view of one embodiment of the present invention. The support illustrated in FIG. 1 occupies the rolling state.

Referring to FIG. 1, support 10 according to the present invention provides: roller assembly 12, moveable member 14 and base 16. Base 16 provides support surface 17 and walls 19. Roller assembly 12 and support surface 17 define volume 18 within which moveable member 14 is positioned. Moveable member 14 divides volume 18 into first volume 20 and second volume 22. Conduit 24 communicates with first volume 20 and is employed to deliver fluid to and remove fluid from first volume 18 to effect rolling and non-rolling states, respectively.

Roller assembly 12 includes roller support 26, axles and bearings 28, and rollers 30. Each roller 30 is rotatable relative to roller support 26. Roller support 26 is fixed relative to user support surface 16. Preferably, rollers 30 protrude into second volume 22.

Figure 2:
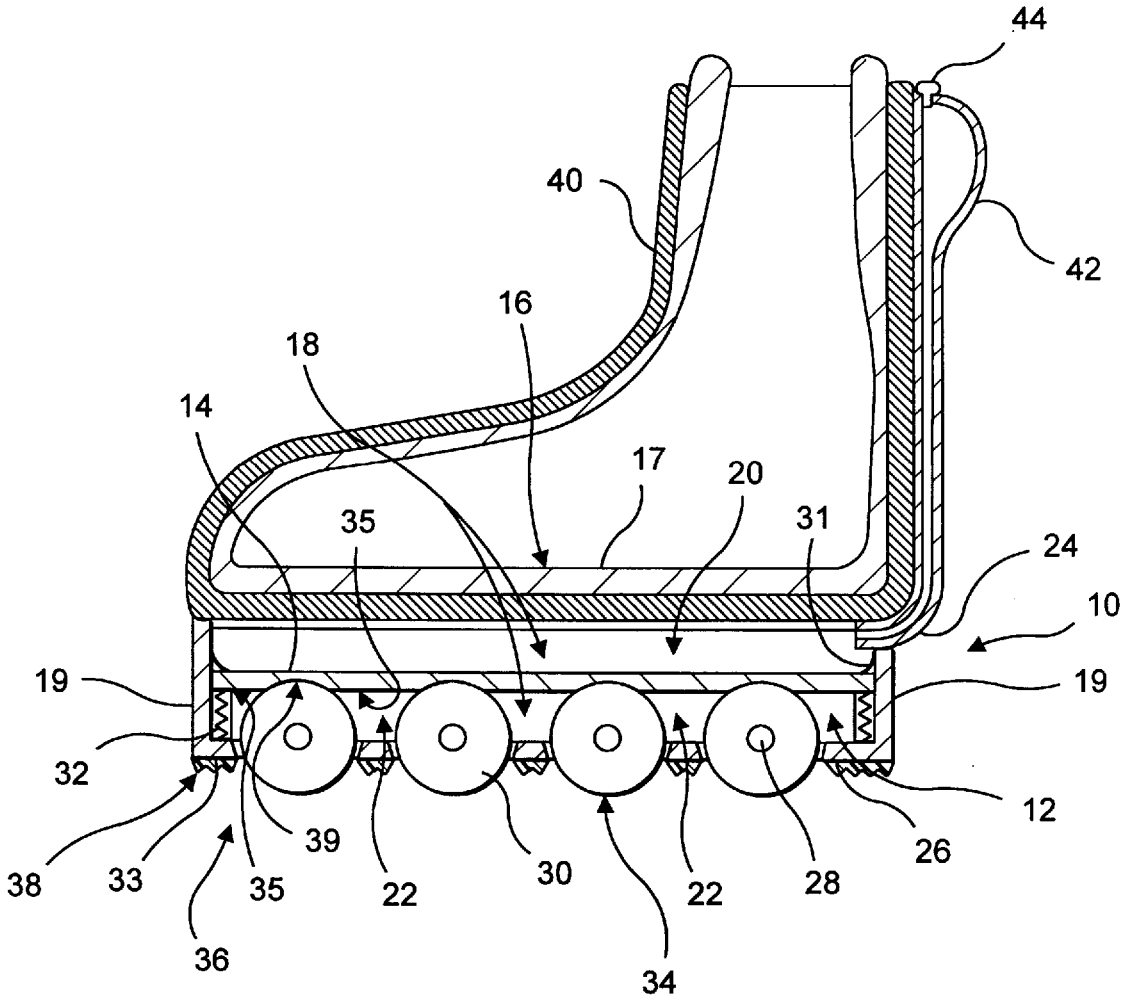
FIG. 2 is a view similar to FIG. 1, however, the support illustrated in FIG. 2 occupies the non-rolling state.

In the embodiment illustrated in FIGS. 1 and 2, moveable member 14 is moveable relative to base 16 and sealingly engages internal surfaces 31 of walls 19. When fluid is introduced through conduit 24 into first volume 20 under pressure, moveable member 14, overcoming the upward force of biasing elements 32, is driven toward rollers 30 of roller assembly 12, thus increasing the volume of first volume 20. Preferably, the pressure required to introduce fluid into first volume 20 and maintain the increased volume of first volume 20 during use of support 10 as a skate/shoe is no more than 100 lbs/in$^2$.

Referring to FIG. 2, continued supply of fluid to first volume 20 causes contact between moveable member 14 and each roller 30 of roller assembly 12. The contact between moveable member 14 and each roller 30 creates friction so as to prevent the rotation of each roller 30 of roller assembly 12. When rotation of rollers 30 is prevented, support 10 occupies a non-rolling state and when support 10 is used as a skate/shoe, the user may walk without sufficient difficulty due to the prevented rotation of rollers 30. While support 10 occupies the non-rolling state, the user walks on the lowermost surface 34 of rollers 30. Preferably, moveable member 14 provides depressions 39 (see FIG. 1) adapted to engage rollers 30 to increase the area of contact between member 14 and rollers 30. Preferably, moveable member 14 is flexible to enhance contact between member 14 and rollers 30 when support 10 occupies the non-rolling state. The contour of underside 36 of support 10 is created by rollers 30 and roller support 26. Preferably, roller support 26 provides walking treads 38 which enhance the non-skid contour of underside 36 of support 10.

As illustrated in FIGS. 1 and 2, support 10 may be attached to shoe or boot 40 for receiving a user's foot. Support 10 may provide means 42 for supplying fluid to and valve means 44 for releasing fluid from first volume 20 through conduit 24. Means 42 and valve means 44 may be integral with support 10, may be attached to support 10, or may be individually removably connectable to support 10. Moveable member 14 may be constructed from resilient material and is biased by a least one biasing element 32 positioned between shoulder 33 of base 16 and the outermost surface 35 of moveable member 14.

Preferably, moveable member 14, base 16, and roller assembly 12 are flexible in a region adapted to align with the ball of the user's foot. When support 10 is used as a skate/shoe. The flexing facilitates walking while support 10 occupies the non-rolling state.

Figure 3:
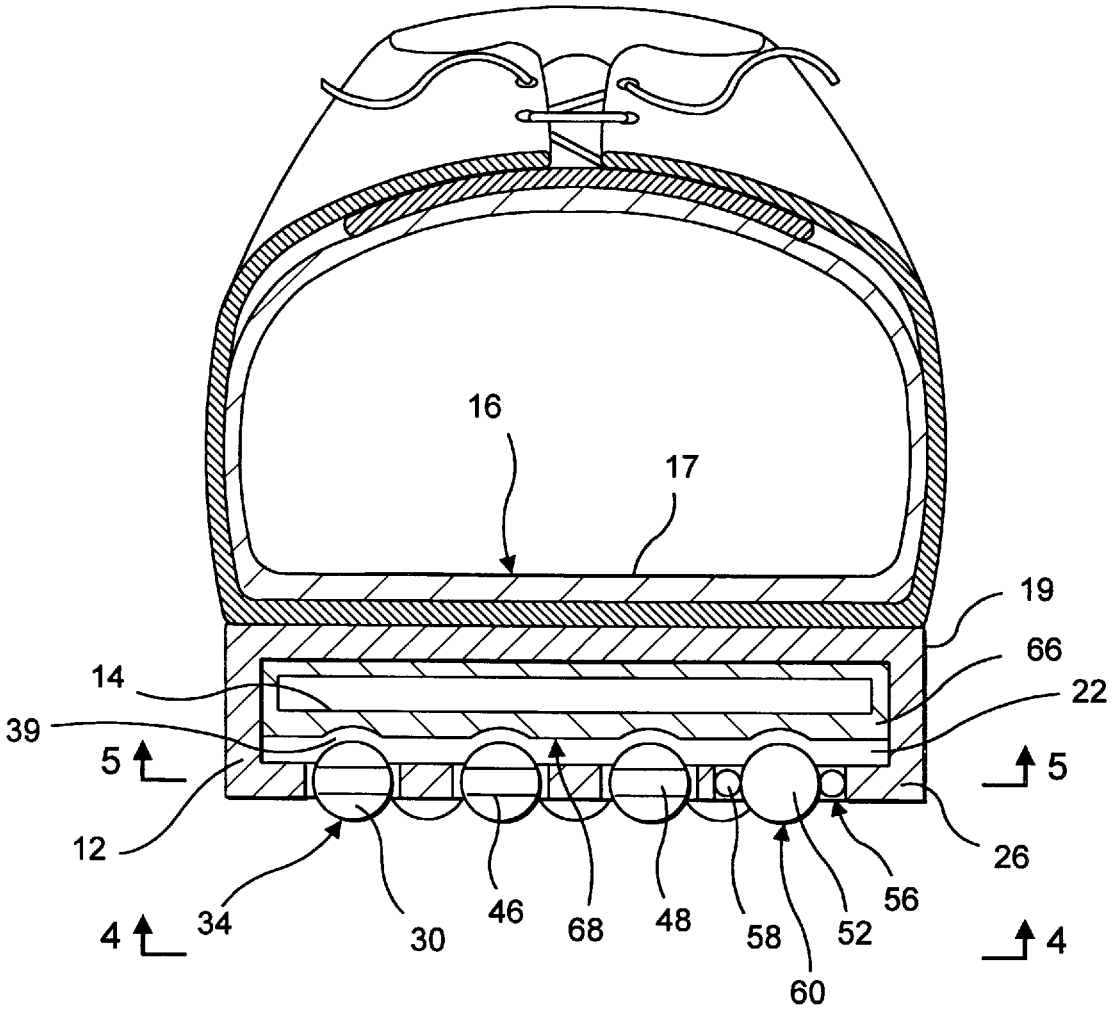
FIG. 3 is a cross-sectional view of a further embodiment of the present invention. The support illustrated in FIG. 3 occupies the rolling state.
Figure 4:
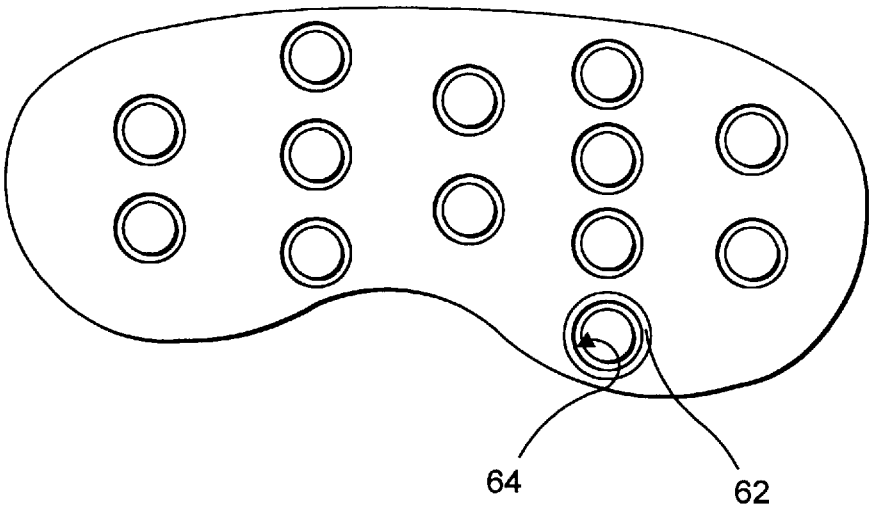
FIG. 4 is a plan view of the support of FIG. 3 taken along line 4—4.
Figure 5:
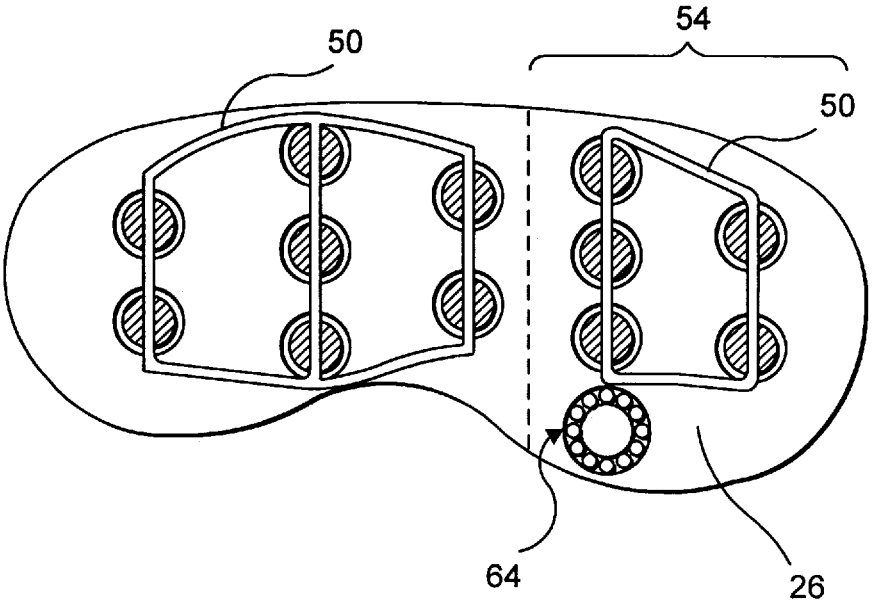
FIG. 5 is a cross-sectional view of the support of FIG. 3 taken along line 5—5.

As illustrated in FIGS. 3 through 5, rollers 30 of roller assembly 12 may be spherical. Rollers 30 each provide bearing means 46 and each protrude into second volume 22. Axel 48 is received by bearing means 46 and is positioned by roller support 26. In the embodiment illustrated in FIG. 5, axles 48 are connected to frames 50 which are embedded within the material which forms roller support 26. Two frames 50 are provided to accommodate flexing of roller support 26 in a region 54 adapted to align with the ball of the user's foot. Alternatively, frames 50 may be flexibly interconnected to achieve the desired flexibility in region 54. In addition, base 16, moveable member 14, and bladder 66 are each flexible in region 54 to facilitate walking while support 10 occupies the non-rolling state. Preferably, the flexible elements are resilient to retain their original shapes.

Support 10 may also provide at least one roller 52 rotatable about multiple axes to permit translation in a direction different from that permitted by rollers 30. Multi-axis roller 52 is placed at an edge of support 10 to permit a user to isolate multi-axis roller 52 by tilting support 10 so that multi-axis roller 52 is the only roller contacting the ground. When used as a skate/shoe, the user may push off using his other foot and roll in any direction for a short period of time. Preferably, multi-axis roller 52 is positioned on the outside edge of support 10 when used as a skate/shoe.

Multi-axis roller 52 is positioned within cavity 56. Cavity 56 communicates with second volume 22 so that rotation of multi-axis roller 52 may be prevented in the same manner as rollers 30. Preferably, multi-axis roller 52 protrudes into second volume 22. Bearings 58 permit multi-axis rotation of roller 52 and position roller 52 so that lowermost surface 60 is within the plane created by lowermost surfaces 34 of rollers 30. Cover 62 provides opening 64 which permits lowermost surface 60 to extend below roller support 26. Opening 64 has a diameter which is smaller than the diameter of multi-axis roller 52 to prevent multi-axis roller from being removed from cavity 56 through opening 64.

Additional structure to provide multi-axis rotation is found in U.S. Pat. No. 1,271,891, the disclosure of which is incorporated herein by reference.

As illustrated in FIG. 3, inflatable bladder 66 provides moveable member 14. Moveable member 14 may be connected to, integral with or separate from bladder 66. When member 14 is integral with bladder 66, bladder 66 may be constructed so as to have an increased thickness at the contact region 68 where bladder 66 is expected to engage rollers 30 of roller assembly 12. In this construction, it may be unnecessary to provide biasing elements 32 because bladder 66 is taught when not inflated. Roller contact region 68 may provide depressions 39 which are positioned to mate with rollers 30 to increase the contact surface area between rollers 30 and moveable member 14.

Bladder 66, when connected to or separate from moveable member 14 may be positioned between support surface 17 and moveable member 14. In such an embodiment, the need for a seal between moveable member 14 and roller support 26 is minimized.

Figure 6:
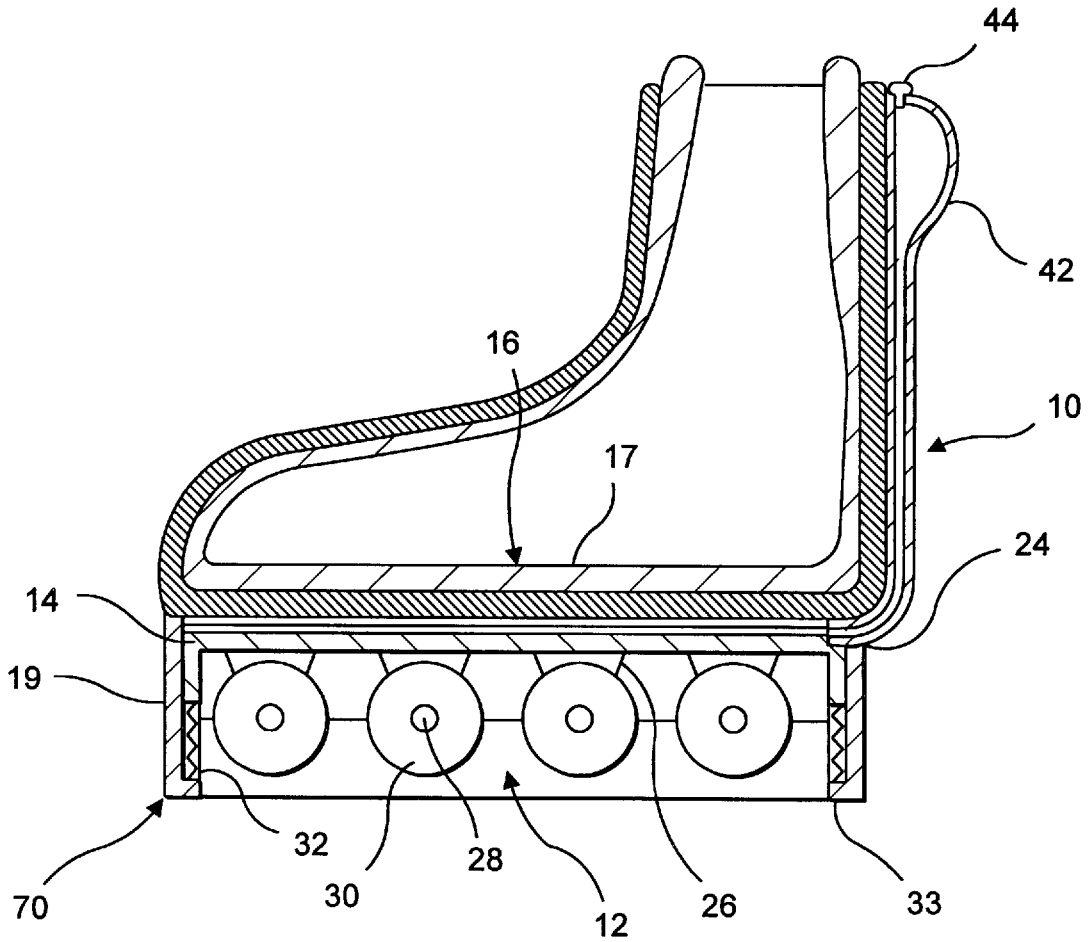
FIG. 6 is a longitudinal, cross-sectional view of another embodiment of the present invention. The support illustrated in FIG. 6 occupies the non-rolling state.

Referring to FIG. 6, a further embodiment of the invention provides: roller assembly 12, moveable member 14, and base 16. Roller assembly 12 is connected to moveable member 14. Moveable member 14 and base 16 define first volume 20. Moveable member 14 and roller assembly 12 are moveable within base 16. Roller assembly 12 includes roller supports 26, axles and bearings 28 and rollers 30. Rollers 30 are rotatable relative to roller support 26. Moveable member 14 and roller assembly 12 are biased to place support 10 into a non-rolling state by biasing elements 32. Upon delivery of fluid under pressure into first volume 20, moveable member 14 and roller assembly 12 are forced away from support surface 17, overcoming the opposing force of biasing elements 32, thus, increasing the volume of first volume 20. Preferably, the maximum pressure required to expand first volume 20 and maintain such expansion during use of support 10 as a skate/shoe is 100 lbs/in$^2$. Biasing elements 32 may be eliminated if a bladder 66 (see FIG. 7) defines volume 22 and if bladder 66 is connected to member 14 and the underside of support surface 17 and is resilient enough to suspend moveable member 14 and roller assembly 12 when support 10 occupies the non-rolling state.

Figure 7:
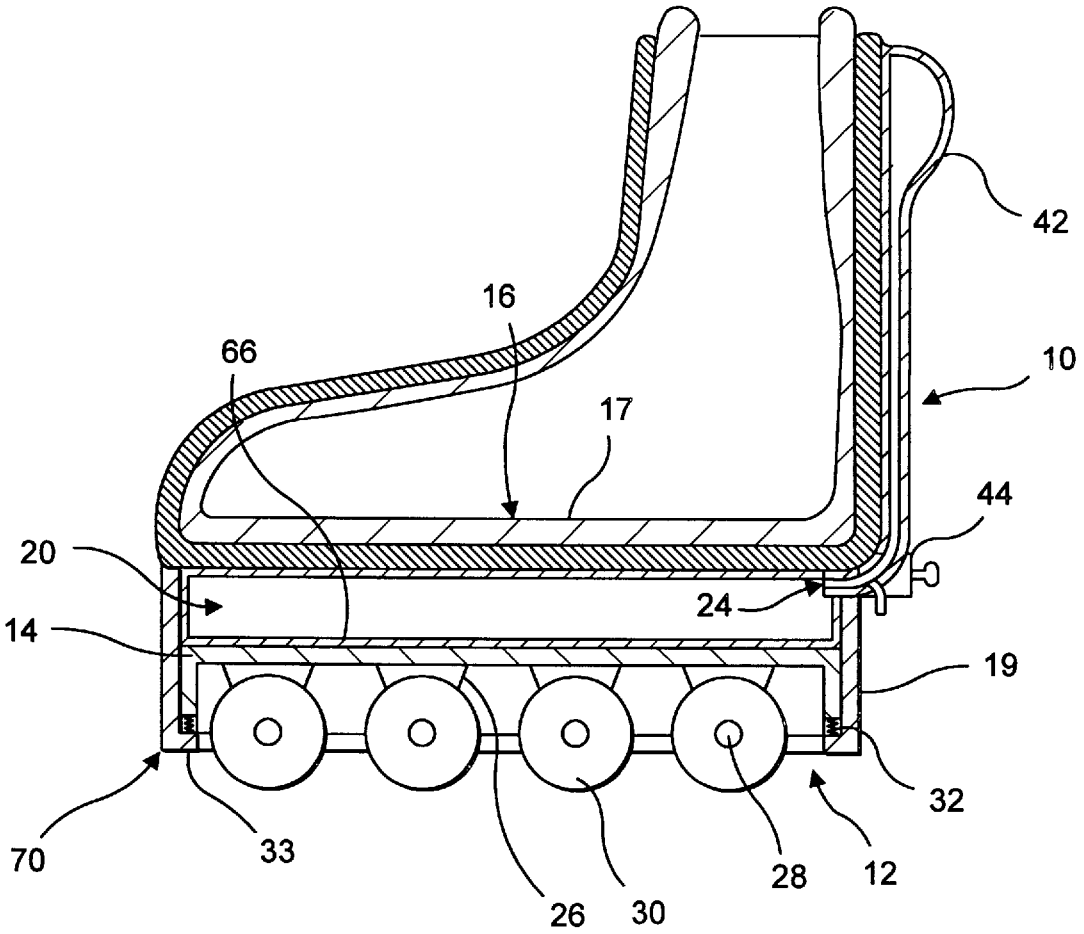
FIG. 7 is a view similar to FIG. 6, however, the support illustrated in FIG. 7 occupies the rolling state.

Referring to FIG. 7, continued delivery of fluid under pressure causes at least a partial extension of rollers 30 beyond lower most edge 70 of base 23 to define the rolling state. Preferably, base 16 provides shoulders 33 which prevent the overextension of moveable member 14 and roller assembly 12 from the base 16 and provide support for biasing elements 32. When support 10 occupies the rolling state, the pressurized fluid in first volume 20 provides for shock absorption as well as controlling the positioning of rollers 30.

FIG. 7 illustrates the positioning of valve means 44 between conduit 24 and pump element 42. Valve means 44 is used to regulate delivery of fluid to and removal of fluid from first volume 20 through conduit 24. Pump element 42 is removable from support 10.

In one embodiment, roller support 26 sealingly engages walls 19 of base 16 so as to provide sealed expandable first volume 20.

In a second embodiment, inflatable bladder 66 is inserted within first volume 20 and roller support 26 need not sealingly engage walls 19 of base 16.

Preferably, lowermost edge 70 provides a non-skid tread 78 to provide a ground contact surface. In addition, the ground contact surface may provide individual openings for each roller 30 of roller assembly 12 or a single opening for all rollers 30.

Figure 8:
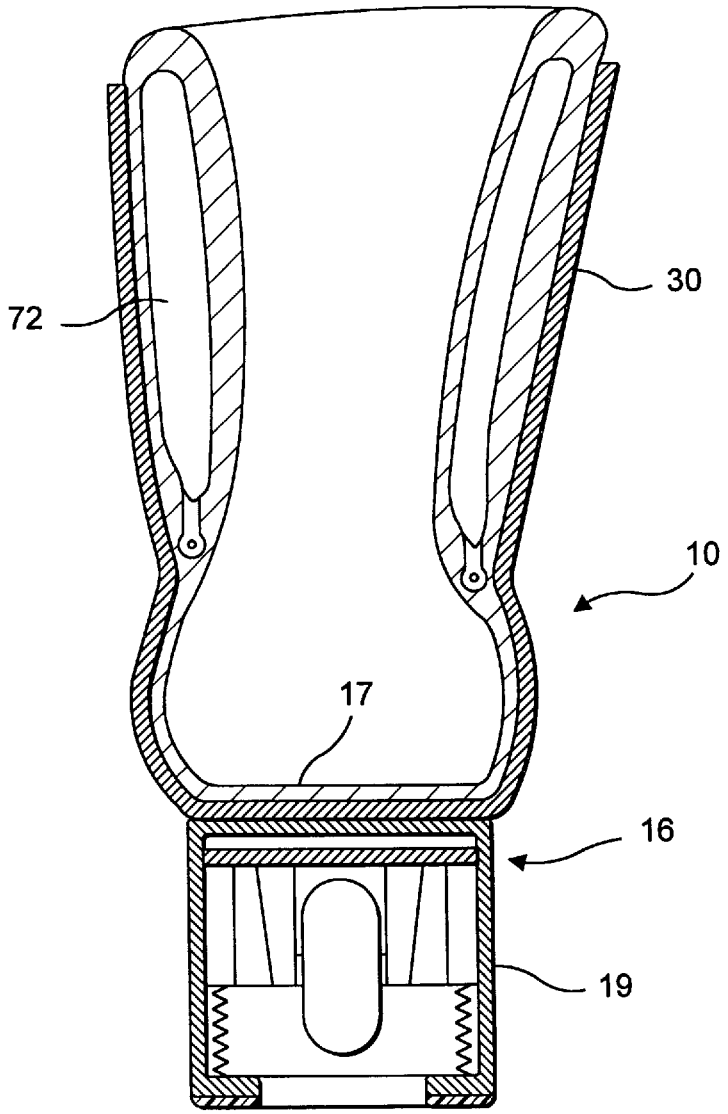
FIG. 8 is a cross-sectional view of an embodiment similar to that illustrated in FIGS. 6 and 7. The support illustrated in FIG. 8 occupies the non-rolling state.

As illustrated in FIG. 8, when support 10 includes shoe 30, shoe 30 may also provide at least one additional bladder 72 to support the user's foot and/or ankle. A separate means 74, 76 for inflating/deflating bladder 72 may be added or the same means 42/44 associated with first volume 20 may be used.

Figure 9:
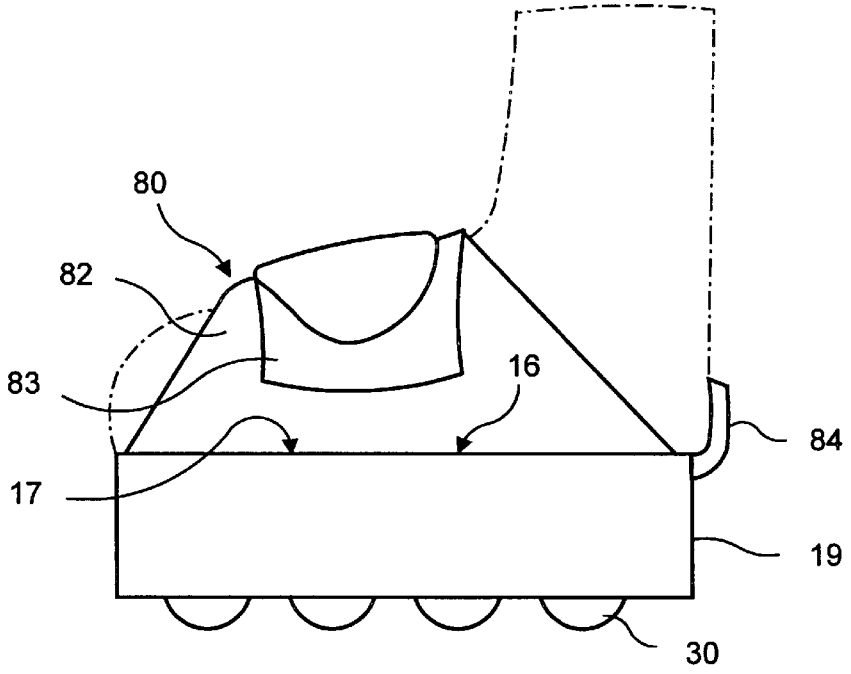
FIG. 9 is a perspective view of an embodiment of the present invention. The support illustrated in FIG. 9 is similar to that illustrated in FIGS. 6 through 8, however, the support of FIG. 9 is removable from a shoe (shown in phantom).

It is possible to removably attach support 10 according to the present invention to an existing shoe. Referring to FIG. 9, the means 80 for removably connecting support 10 to a shoe may take the form of removable and adjustable engageable belts 82 having buckles or other adjustable fastening means 83. In addition, positioning element 84 is provided to position a user's shoe on support surface 17.

Figure 10:
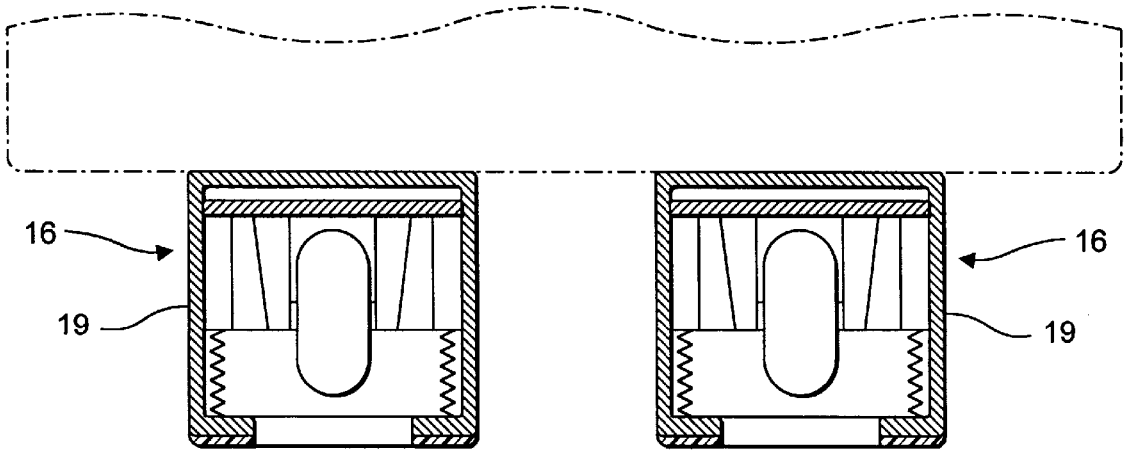
FIG. 10 is a cross-sectional view of an alternate embodiment of the present invention. The support illustrated in FIG. 10 is similar to that illustrated in FIGS. 6 through 8, however, the support of FIG. 10 is connectable to a frame, furniture, or equipment (shown in phantom).

Referring to FIG. 10, one or more supports 10 may be connected to a frame, a piece of furniture, or a piece of equipment to provide rolling and non-rolling states. Preferably, supports 10, attached for purposes of moving furniture or equipment, provide only rollers 52 capable of rotating about multiple axes.

The fluid introduced into first volume 20 in each embodiment of the invention discussed herein may be air, water, other gases, other liquids or a gel.

Although the invention is illustrated quite simply in the figures, it is not beyond the scope of the invention to provide multiple expandable volumes where the present disclosure discusses a single volume. In the multiple volume construction, multiple separation walls may improve relative stability and promote level positioning and placement. Furthermore, while a number of embodiments have been described having specific features, it is not beyond the scope of the present invention that any one or more features of one embodiment may be combined with any one or more features of other embodiments.

What is claimed is:

1. A shoe which can be used as a walking shoe or as a rolling shoe, said shoe comprising:

(1) a multi-state support which can be positioned in a stationary state and a rolling state, said multi-state support including:

a U-shaped base;

a member which is fitted into said u-shaped base, said member being movable within said u-shaped based to define a first chamber formed between said movable member and said U-shaped base; and a roller assembly which is connected to said movable member, said roller assembly including a plurality of rollers and biasing means connected between the movable member and the U-shaped base;

(2) a first inflatable bladder for supporting at least one of the user's foot or ankle; and (3) a fluid delivery means for selectively delivering pressurized fluid to said first chamber and to said first inflatable bladder;

wherein said biasing means places the multi-state support in a stationary state by moving the member, with the rollers connected thereto, upwardly into the U-shaped base, and said fluid delivery means, upon delivering pressurized fluid to said first chamber and said first bladder, respectively places said multi-state support in a rolling state by moving the member downwardly and placing the rollers into enegaegment with a ground surface and provides an air lock around the user's ankle.

2. The shoe according to claim 1, wherein said roller assembly further includes:

roller supports;

axles; and bearings.

3. The shoe according to claim 1, wherein said fluid delivery means further includes:

a pump;

a valve means for regulating the delivery and removal of fluid to and from said first volume; and, a conduit for connecting said pump to said first inflatable bladder and said first chamber.

4. The shoe according to claim 1, wherein said fluid delivery means further includes a second inflatable bladder which is inserted into said first chamber.

* * * * *